United States Patent [19]

Hsieh

[11] Patent Number: 4,475,925

[45] Date of Patent: Oct. 9, 1984

[54] GASIFICATION PROCESS FOR CARBONACEOUS MATERIALS

[75] Inventor: C. Richard Hsieh, San Rafael, Calif.

[73] Assignee: Chevron Research Company, San Francisco, Calif.

[21] Appl. No.: 450,936

[22] Filed: Dec. 20, 1982

[51] Int. Cl.[3] ..... C10J 3/54

[52] U.S. Cl. ..... 48/197 R; 48/202

[58] Field of Search ..... 48/197 R, 202, 206, 48/210, DIG. 4; 252/373

[56] References Cited

U.S. PATENT DOCUMENTS

| | | | |
|---|---|---|---|
| 2,614,038 | 10/1952 | Ban | 48/206 |
| 4,157,245 | 6/1979 | Mitchell et al. | 48/202 |
| 4,204,843 | 5/1980 | Neavel | 48/202 |
| 4,318,712 | 3/1982 | Lang et al. | 48/202 |

*Primary Examiner*—Peter F. Kratz

*Attorney, Agent, or Firm*—S. R. LaPaglia; W. K. Turner; E. A. Schaal

[57] ABSTRACT

A method for the gasification of a carbonaceous material is disclosed wherein a carbonaceous material containing potassium nitrate and a solid heat-transfer material comprising sintered bauxite are introduced into a reaction vessel, then the carbonaceous material is reacted with steam to form a hot char and a gaseous product, wherein the heat necessary for said reaction is supplied by the heat-transfer material. Preferably, the carbonaceous material contains from 2 percent to 15 percent potassium nitrate. More preferably, the carbonaceous material is petroleum coke mixed with about 5 percent potassium nitrate.

3 Claims, No Drawings

GASIFICATION PROCESS FOR CARBONACEOUS MATERIALS

BACKGROUND OF THE INVENTION

The present invention involves an improved method for gasification of carbonaceous materials.

In view of recent increases in the price of crude oil, researchers have been searching for alternative sources of energy and hydrocarbons. Much research has focused on recovering the hydrocarbons from hydrocarbon-containing solids such as shale, tar sand or coal by heating or pyrolysis to boil off or liquefy the hydrocarbons trapped in the solid or by reacting the solid with steam, for example, to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted.

In a typical coal gasification process, coal is contacted with steam and an oxygen-containing gas to produce a gaseous product.

When air is used as the oxygen-containing gas, the gaseous product contains high levels of nitrogen, which reduces the BTU content of the gaseous product. Some processes have used pure oxygen instead of air, in order to avoid having nitrogen in the gaseous product. This does eliminate the nitrogen from the product but it requires a source of pure oxygen, some oxygen plants are almost as large as the coal gasification plant they are supplying. Thus, one was faced with the alternatives of either producing a gaseous product diluted with nitrogen or finding a source of pure oxygen for their process.

Another solution to the nitrogen dilution problem is disclosed in U.S. Pat. No. 4,157,245. In one embodiment of the invention disclosed in that patent, a solid heat-transfer material, such as sand, is introduced into an upper portion of a reaction vessel and coal is introduced into a lower portion of the vessel. The physical characteristics of the heat-transfer material and the coal differ such that a superficial velocity of a fluid flowing upwardly through the vessel is greater than the minimum fluidizing velocity of the heat-transfer material and the terminal velocity of the coal, but is less than the terminal velocity of the heat-transfer material. A substantially countercurrent vertical flow of the two solids is maintained in the vessel without substantial top-to-bottom backmixing by passing steam upwardly through the vessel at a rate sufficient to fluidize the heat-transfer material and entrain the coal whereby the heat-transfer material substantially flows downwardly in a fluidized state through the vessel and the coal substantially flows upwardly in an entrained state through the vessel. The steam reacts with the coal to form a hot char and a gaseous product. The heat-transfer material acts as a source of heat for the reaction between the steam and the coal. Cooled heat-transfer material is removed from a lower end of the vessel and the hot char and the gaseous product are removed from an upper end of the vessel. The gaseous product is then separated from the hot char by regular separation techniques.

In one method, the heat-transfer material can be heated by introducing it into an upper portion of a combustion zone, introducing the hot char into a lower portion of the zone, and contacting the heat-transfer material with the hot char while maintaining substantially countercurrent plug flow of the two solids by passing air upwardly through the combustion zone at a rate sufficient to fluidize the heat-transfer material and entrain the char. The heat-transfer material substantially flows downwardly through the combustion zone in a fluidized state and is heated while the char substantially flows upwardly through the combustion zone in an entrained state and is combusted.

The process in U.S. Pat. No. 4,157,245 is based in part on the discovery that in the typical coal gasification process, there are two separate reactions occurring in the same vessel: (1) an endothermic reaction between the coal and steam which produces the gaseous product, and (2) an exothermic reaction between the coal and the oxygen-containing gas which produces the heat necessary for the first reaction. The process of U.S. Pat. No. 4,157,245 separates these two reactions in two separate vessels and transfers the heat generated by the second reaction to the site of the first reaction via a heat-transfer material.

A major advantage of this process is that air can be used as the oxidizing gas without causing the resulting gaseous product to be diluted with nitrogen.

It would be advantageous to be able to use this coal gasification process as a means of disposing of coke produced by processing petroleum residuum, tar sand bitumen, shale oil, coal oil or other heavy hydrocarbons, but the reactivity of coke is low. The literature has suggested that alkali metal salts, especially those of potassium and sodium, can significantly improve the reactivity of coke, but, when these salts are used with sand in the above process, these salts tend to make the heat-transfer material agglomerate at high temperature.

SUMMARY OF THE INVENTION

The present invention overcomes the deficiencies of the prior art by using potassium nitrate as a catalyst and sintered bauxite as the heat-transfer material.

Preferably, the carbonaceous material contains from 2 percent to 5 percent potassium nitrate. More preferably, the carbonaceous material is petroleum coke mixed with about 5 percent potassium nitrate.

Preferably, a solid sintered bauxite is introduced into an upper portion of a vertically elongated reaction vessel having a means for substantially impeding vertical backmixing of vertically moving solids in the vessel. A petroleum coke mixed with about 5 percent potassium nitrate is introduced into a lower portion of the vessel. The physical characteristics of the sintered bauxite and the petroleum coke differ such that a superficial velocity of a fluid flowing upwardly through the vessel is greater than the minimum fluidizing velocity of the sintered bauxite and the terminal velocity of the petroleum coke, but is less than the terminal velocity of the sintered bauxite.

In this embodiment, steam is passed upwardly through the vessel at a rate sufficient to fluidize the sintered bauxite and entrain the petroleum coke to maintain substantially countercurrent vertical flow of the sintered bauxite and petroleum coke in the vessel without substantial top-to-bottom backmixing of the sintered bauxite and the petroleum coke in the vessel. The sintered bauxite substantially flows downwardly in a fluidized state through the vessel and the petroleum coke substantially flows upwardly in an entrained state through the vessel. The steam reacts with the petroleum coke to form a hot char and a gaseous product, wherein the heat necessary for the reaction is supplied by the sintered bauxite.

The sintered bauxite is then removed from a lower end of the vessel at a temperature substantially lower than the temperature at which the sintered bauxite was introduced into the vessel, and at least a portion of the sintered bauxite is introduced into an upper portion of a vertically elongated combustion zone having means for substantially impeding vertical backmixing of vertically moving solids substantially throughout the combustion zone. The hot char and the gaseous product are removed from an upper end of the vessel, the hot char is separated from the gaseous product, and at least a portion of the hot char is introduced into a lower portion of the combustion zone. Then the sintered bauxite is heated to an elevated temperature in the combustion zone by contacting the sintered bauxite with the hot char while maintaining substantially countercurrent plug flow of the sintered bauxite and the hot char by passing air upwardly through the combustion zone at a rate sufficient to fluidize the sintered bauxite and entrain the hot char. The sintered bauxite substantially flows downwardly through the combustion zone in a fluidized state and is heated to an elevated temperature while the hot char substantially flows upwardly through the combustion zone in an entrained state and is combusted. Then at least a portion of the sintered bauxite is then recycled to the reaction vessel.

DESCRIPTION OF THE PREFERRED EMBODIMENTS

In its broadest aspect, the present invention involves the use of a sintered bauxite as a heat carrier and potassium nitrate as a catalyst in the gasification of a carbonaceous material, such as petroleum coke.

The present invention can be used in any gasification process having a reaction vessel. Generally, a carbonaceous material containing potassium nitrate is introduced with a heat-transfer material made of sintered bauxite into a reaction vessel where the carbonaceous material is reacted with steam to form a hot char and a gaseous product. The necessary heat for this reaction is supplied by a heat-transfer material.

Sintered bauxite is used as the heat-transfer material because it has less tendency to agglomerate in the presence of alkali metal catalysts than other heat-transfer materials. When potassium nitrate is used as a catalyst in conjunction with sintered bauxite, there is no agglomeration of the heat-transfer material, even at the high temperatures of the coal gasification process.

The potassium nitrate is combined with the carbonaceous material before the carbonaceous material is introduced into the reaction vessel. The potassium nitrate can be combined with the carbonaceous material by any conventional technique, such as mixing or impregnation. Preferably, the potassium nitrate is mixed with the carbonaceous material. Preferably, the carbonaceous material contains from 2 percent to 15 percent potassium nitrate, more preferably, about 5 percent potassium nitrate.

Various carbonaceous materials can be used, such as coal and petroleum coke. Preferably, the carbonaceous material is a petroleum coke.

The present invention can be used in the processes disclosed in U.S. Pat. No. 4,157,245. U.S. Pat. No. 4,157,245 is hereby incorporated by reference to disclose a coal gasification process which can be benefited by this process.

In one particular embodiment of the present invention, a solid sintered bauxite is introduced into an upper portion of a vertically elongated reaction vessel which has a means for substantially impeding vertical backmixing of vertically moving solids in the vessel. A petroleum coke mixed with about 5 percent potassium nitrate is introduced into a lower portion of the vessel. The physical characteristics of the sintered bauxite and the coke must differ such that a superficial velocity of a fluid flowing upwardly through the vessel is greater than the minimum fluidizing velocity of the sintered bauxite and the terminal velocity of the coke, but is less than the terminal velocity of the sintered bauxite.

Then steam is passed upwardly through the vessel at a rate sufficient to fluidize the sintered bauxite and entrain the coke to maintain substantially countercurrent vertical flow of the sintered bauxite and petroleum coke in the vessel without substantial top-to-bottom backmixing of the sintered bauxite and coke in the vessel. The sintered bauxite substantially flows downwardly in a fluidized state through the vessel. The coke substantially flows upwardly in an entrained state through the vessel and the steam reacts with the coke to form a hot char and a gaseous product. The heat necessary for that reaction is supplied by the sintered bauxite. The sintered bauxite is removed from a lower end of the vessel at a temperature substantially lower than the temperature at which the sintered bauxite was introduced into the vessel. The hot char and the gaseous product are removed from an upper end of the vessel, and the hot char is separated from the gaseous product.

In the second part of this embodiment, at least a portion of the sintered bauxite is introduced into an upper portion of a vertically elongated combustion zone having means for substantially impeding vertical backmixing of vertically moving solids substantially throughout the combustion zone. A portion of the hot char is introduced into a lower portion of the combustion zone. The sintered bauxite is heated to an elevated temperature in the combustion zone by contacting the sintered bauxite with the hot char while maintaining substantially countercurrent plug flow of the sintered bauxite and the hot char by passing air upwardly through the combustion zone at a rate sufficient to fluidize the sintered bauxite and entrain the hot char. The sintered bauxite substantially flows downwardly through the combustion zone in a fluidized state and is heated to an elevated temperature while the char substantially flows upwardly through the combustion zone in an entrained state and is combusted. At least a portion of the sintered bauxite is recycled to the reaction vessel.

EXAMPLES

The invention will be further illustrated by the following examples which set forth a particularly advantageous method and composition embodiments. While the examples are provided to illustrate the present invention, they are not intended to limit it.

In this bench-scale study, the effect of several alkali metal compounds was determined on the reactivity of a petroleum coke. The fusion/agglomeration tendency of these salts was examined in combination with two different heat carriers—a silica sand and a sintered bauxite.

Reactivity

All samples had 200/325 mesh size. The catalyst was admixed with the coke. The reactivity of the samples was measured with a Du Pont 951 TGA analyzer. A 10–15 mg sample was heated at 20° C./minute in nitrogen at 900° C. The temperature was held at 900° C. until the sample weight was constant. Nitrogen was then bubbled through water at room temperature to generate a humidified gas over the char. An X-Y plotter followed the sample weight loss as a function of time. The reactivity of the sample is defined as:

$$R = \frac{1}{w_o}\left(\frac{dw}{dt}\right)_m$$

where $w_o$ is the initial weight, and $$\left(\frac{dw}{dt}\right)_m$$

is the maximum rate of weight loss. This is usually the same as the initial rate, although in some cases there is a brief induction period at the beginning of the run.

Table I shows the inspection of the petroleum coke and a reactive lignite char used in the experiments. Table II summarizes the effect of alkali metal salts on coke gasification. As expected, the steam gasification rate for the petroleum coke is about an order of magnitude less than that for the lignite char. The various potassium compounds improved the reactivity of the coke by a factor of 9–21.

Fusion/Agglomeration

All samples contained 5 percent catalyst and 95 percent heat carrier—either a 16/20 mesh silica sand or a 12/20 mesh sintered bauxite. To make a run, a 5-g sample was placed in a ceramic boat and positioned in the center of a furnace. The sample was heated to the desirable temperature in nitrogen and then exposed to air for 30 minutes. After the sample cooled down, the sample was visually inspected to determine the extent of fusion-/agglomeration.

Table III summarizes the observed interaction of alkali metal salts with heat carrier. Silica sand showed no sign of agglomeration at 2000° F. However, in the presence of KOH, $K_2CO_3$, or $KNO_3$, it showed severe fusion/agglomeration at 1500° F. Sintered bauxite was a better heat carrier. The presence of KOH results in slight agglomeration at 1500° F. $K_2CO_3$ did not cause any agglomeration at 1500° F. but generated some at 1800° F. $KNO_3$, in combination with sintered bauxite, showed no fusion/agglomeration at 1800° F.

TABLE I

Inspection of a Petroleum Coke and a Lignite Char

| | Petroleum Coke | Lignite Char |
|---|---|---|
| Proximate Analysis, Wt. % | | |
| Moisture | 2.27 | 7.99 |
| Volatile | 11.15 | 13.00 |
| Fixed Carbon | 86.05 | 59.98 |
| Ash | 0.53 | 19.03 |
| Ultimate Analysis, Wt. % | | |
| $H_2O$ | 2.27 | 7.99 |
| C | 89.00 | 64.89 |
| H | 3.59 | 2.03 |
| N | 2.24 | 0.90 |
| Cl | 0 | 0.03 |
| S | 2.08 | 2.61 |
| O | 0.29 | 2.52 |
| Ash | 0.53 | 19.03 |

TABLE II

Effect of Alkali Metal Salts On Coke Gasification

| Sample | Reactivity, 1/Hour |
|---|---|
| Husky Lignite Char | 0.56 |
| Petroleum Coke (PC) | 0.07 |
| PC + 20% Catalyst | |
| CaO | 0.07 |
| $K_2CrO_4$ | 0.62 |
| $K_2CO_3$ | 1.13 |
| $KNO_3$ | 1.25 |
| KOH | 1.51 |

TABLE III

Interaction of Alkali Metal Salts With Heat Carrier

| Sample | Temperature, ° F. | Fusion/ Agglomeration |
|---|---|---|
| Silica Sand (SS) | 2000 | None |
| SS + 5% Catalyst | | |
| KOH | 1500 | Severe |
| $K_2CO_3$ | 1500 | Severe |
| $KNO_3$ | 1500 | Severe |
| Sintered Bauxite (SB) | 2000 | None |
| SB + 5% Catalyst | | |
| KOH | 1500 | Slight |
| $K_2CO_3$ | 1500 | None |
| $KNO_3$ | 1500 | None |
| $K_2CO_3$ | 1800 | Slight |
| $KNO_3$ | 1800 | None |

While the present invention has been described with reference to specific embodiments, this application is intended to cover those various changes and substitutions which may be made by those skilled in the art without departing from the spirit and scope of the appended claims.

What is claimed is:

1. A method for the gasification of a carbonaceous material comprising:

(a) introducing a solid sintered bauxite into an upper portion of a vertically elongated reaction vessel, the vessel having a means for substantially impeding vertical backmixing of vertically moving solids in the vessel;

(b) introducing a carbonaceous material mixed with potassium nitrate into a lower portion of said vessel, the physical characteristics of the sintered bauxite and the carbonaceous material differing such that a superficial velocity of a fluid flowing upwardly through the vessel is greater than the minimum fluidizing velocity of the sintered bauxite and the terminal velocity of the carbonaceous material, but is less than the terminal velocity of the sintered bauxite;

(c) passing steam upwardly through said vessel at a rate sufficient to fluidize the sintered bauxite and entrain the carbonaceous material to maintain substantially countercurrent vertical flow of the sintered bauxite and carbonaceous material in the vessel without substantial top-to-bottom backmixing of the sintered bauxite and the carbonaceous material in the vessel, whereby the sintered bauxite substantially flows downwardly in a fluidized state through the vessel and the carbonaceous material substantially flows upwardly in an entrained state through the vessel, whereby the steam reacts with the carbonaceous material to form a hot char and a gaseous product, wherein the heat necessary for said reaction is supplied by the sintered bauxite;

(d) removing the sintered bauxite from a lower end of said vessel at a temperature substantially lower than the temperature at which the sintered bauxite was introduced into the vessel.

2. A method for the gasification of a carbonaceous material according to claim 1 comprising the additional steps of:

(e) introducing at least a portion of the sintered bauxite into an upper portion of a vertically elongated combustion zone having means for substantially impeding vertical backmixing of vertically moving solids substantially throughout the combustion zone;

(f) removing the hot char and the gaseous product from an upper end of said vessel, separating the hot char from the gaseous product, and introducing at least a portion of said hot char into a lower portion of the combustion zone;

(g) heating the sintered bauxite to an elevated temperature in said combustion zone by contacting the sintered bauxite with the hot char while maintaining substantially countercurrent plug flow of the sintered bauxite and the hot char by passing air upwardly through the combustion zone at a rate sufficient to fluidize the sintered bauxite and entrain the hot char, whereby the sintered bauxite substantially flows downwardly through the combustion zone in a fluidized state and is heated to an elevated temperature while the hot char substantially flows upwardly through the combustion zone in an entrained state and is combusted; and (h) recycling at least a portion of said sintered bauxite to said reaction vessel.

3. A method for the gasification of petroleum coke comprising:

(a) introducing a solid sintered bauxite into an upper portion of a vertically elongated reaction vessel, the vessel having a means for substantially impeding vertical backmixing of vertically moving solids in the vessel;

(b) introducing a petroleum coke mixed with potassium nitrate into a lower portion of said vessel, wherein said petroleum coke comprises about 5 percent potassium nitrate, the physical characteristics of the sintered bauxite and the petroleum coke differing such that a superficial velocity of a fluid flowing upwardly through the vessel is greater than the minimum fluidizing velocity of the sintered bauxite and the terminal velocity of the petroleum coke, but is less than the terminal velocity of the sintered bauxite;

(c) passing steam upwardly through said vessel at a rate sufficient to fluidize the sintered bauxite and entrain the petroleum coke to maintain substantially countercurrent vertical flow of the sintered bauxite and petroleum coke in the vessel without substantial top-to-bottom backmixing of the sintered bauxite and the petroleum coke in the vessel, whereby the sintered bauxite substantially flows downwardly in a fluidized state through the vessel and the petroleum coke substantially flows upwardly in an entrained state through the vessel, whereby the steam reacts with the petroleum coke to form a hot char and a gaseous product, wherein the heat necessary for said reaction is supplied by the sintered bauxite;

(d) removing the sintered bauxite from a lower end of said vessel at a temperature substantially lower than the temperature at which the sintered bauxite was introduced into the vessel;

(e) introducing at least a portion of the sintered bauxite into an upper portion of a vertically elongated combustion zone having means for substantially impeding vertical backmixing of vertically moving solids substantially throughout the combustion zone;

(f) removing the hot char and the gaseous product from an upper end of said vessel, separating the hot char from the gaseous product, and introducing at least a portion of said hot char into a lower portion of the combustion zone;

(g) heating the sintered bauxite to an elevated temperature in said combustion zone by contacting the sintered bauxite with the hot char while maintaining substantially countercurrent plug flow of the sintered bauxite and the hot char by passing air upwardly through the combustion zone at a rate sufficient to fluidize the sintered bauxite and entrain the hot char, whereby the sintered bauxite substantially flows downwardly through the combustion zone in a fluidized state and is heated to an elevated temperature while the hot char substantially flows upwardly through the combustion zone in an entrained state and is combusted; and (h) recycling at least a portion of said sintered bauxite to said reaction vessel.

* * * * *

UNITED STATES PATENT AND TRADEMARK OFFICE

CERTIFICATE OF CORRECTION

PATENT NO. : 4,475,925

DATED : October 9, 1984

INVENTOR(S) : C. RICHARD HSIEH

It is certified that error appears in the above-identified patent and that said Letters Patent are hereby corrected as shown below:

Col. 2, line 41, "5 percent" should read --15 percent--

Col. 5, line 2, "at 900°" should read --to 900°--

Col. 5, line 40, "fusion-agglomeration" should read --fusion/agglomeration--

Signed and Sealed this

*Twenty-eighth* Day of *May 1985*

[SEAL]

*Attest:*

DONALD J. QUIGG

*Attesting Officer* *Acting Commissioner of Patents and Trademarks*